US005630576A

United States Patent [19]

Williams

[11] Patent Number: 5,630,576

[45] Date of Patent: May 20, 1997

[54] SADDLE CLAMP WORKPIECE CLAMPING APPARATUS

[76] Inventor: Willis R. Williams, 767 S. Fielder, Arlington, Tex. 76013

[21] Appl. No.: 514,436

[22] Filed: Aug. 11, 1995

[51] Int. Cl.[6] ..... B25B 1/20

[52] U.S. Cl. ..... 269/45; 269/88; 269/99; 269/296; 269/900

[58] Field of Search ..... 269/9, 37, 40, 269/45, 88, 96, 99, 100, 101, 147, 166, 170, 203, 246, 268, 292, 296, 900, 906, 909, 910

[56] References Cited

U.S. PATENT DOCUMENTS

| | | | |
|---|---|---|---|
| 1,026,475 | 5/1912 | Tarbuck | 269/100 |
| 4,170,345 | 10/1979 | Townsend | 269/99 |
| 4,445,678 | 5/1984 | George | 269/99 |
| 4,592,541 | 6/1986 | Huray | 269/155 |
| 4,794,687 | 1/1989 | Peters et al. | 269/900 |
| 4,928,939 | 5/1990 | Bell et al. | 269/900 |

*Primary Examiner*—Robert C. Watson
*Assistant Examiner*—Thomas W. Lynch
*Attorney, Agent, or Firm*—Henderson & Sturm

[57] ABSTRACT

A workpiece clamping apparatus for securing a workpiece relative to a planar support surface has a pair of saddle clamp members each provided with a plurality of threaded apertures. A mounting member associated with selected ones of the plurality of threaded apertures is provided for operably attaching saddle clamp members to the planar support surface in a variety of orientations. Each saddle clamp member can engage a portion of a bar clamp. Each saddle clamp member can also engage a portion of a length of pipe which can have pipe clamps thereon.

6 Claims, 2 Drawing Sheets

SADDLE CLAMP WORKPIECE CLAMPING APPARATUS

TECHNICAL FIELD

The present invention relates to clamping arrangements in general and in particular to a workpiece clamping apparatus for securing a workpiece to a planar support surface.

BACKGROUND ART

Up until the present time, both professional and amateur craftsmen have been frustrated by the failure of the industry to provide an economically priced worktable that offers both a stable work surface and/or platform that is specifically designed to accommodate a wide variety of power tools, clamps and accessories to allow the draftsmen to perform a variety of tasks on different workpieces.

With the impending introduction of the subject matter of patent application Ser. No. 08/245,286 filed May 16, 1994, now U.S. Pat. No. 5,584,254, and entitled Collapsible Workbench Apparatus, a part of the solution to the above stated problem will be in place.

This particular invention involves a new style, collapsible workbench whose work surface employs a novel combination of channel tracks and spaced apertures that not only lend themselves to the mounting of existing power tools but which have also spawned an entire family of workpiece clamping apparatus that can be employed both alone and in combination with one another to immobilize a workpiece relative to the newly designed work surface.

DISCLOSURE OF THE INVENTION

An object of the present invention is to provide a workpiece clamping apparatus that will securely position a workpiece relative to a planar support surface.

Another object of the present invention is to provide a workpiece clamping apparatus that can be accommodated on any work support surface provided with rows of apertures and/or a plurality of channel tracks to fixedly secure a workpiece relative to the work support surface.

A further object of the present invention is to provide a workpiece clamping apparatus that can be used either alone or in combination with other related workpiece clamping apparatus to secure various workpieces in a variety of different orientations, both relative to a work support surface and/or the different workpiece clamping apparatus.

Still another object of the present invention is to provide a family of workpiece clamping apparatus components that can be combined with other related components in a variety of ways to produce different clamping configurations.

Yet another object of the present invention is to provide a workpiece clamping apparatus that is economically priced, rugged in construction, simple to use, either by itself or in combination with other clamping arrangements, and which has a long useful life.

BRIEF DESCRIPTION OF THE DRAWINGS

These and other attributes of the invention will become more clear upon a thorough study of the following description of the best mode for carrying out the invention particularly when reviewed in conjunction with the accompanying drawings wherein.

BEST MODE FOR CARRYING OUT THE INVENTION

Figure 1:
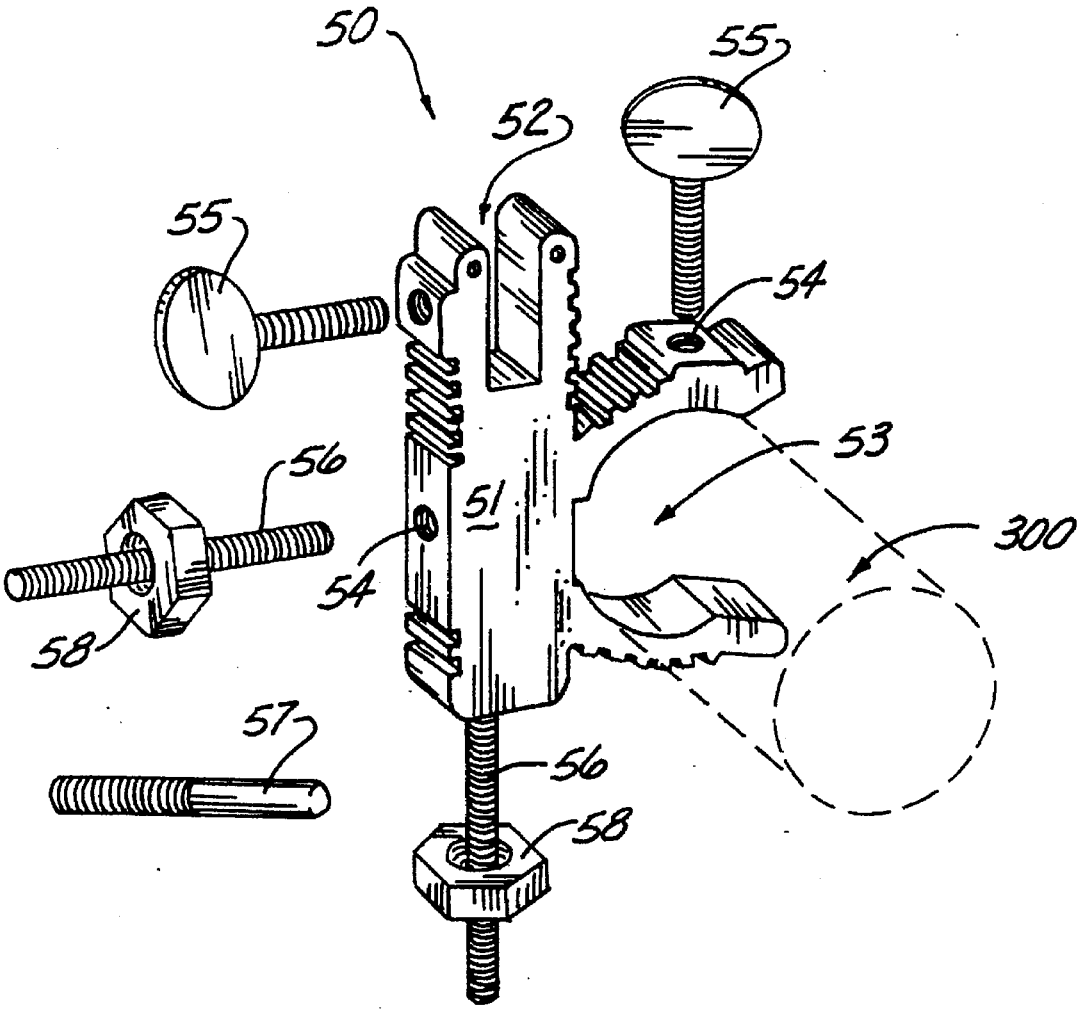
FIG. 1 is an exploded perspective view of a saddle clamp employed in conjunction with the work piece clamping apparatus of this invention.

As can be seen by reference to the drawings, in particular to FIG. 1, the work piece clamping apparatus that forms the basis of the present invention is designated generally by the reference numeral 10. Prior to embarking upon a detailed description of the work piece clamping apparatus 10 it would first be advisable to discuss the environment in which this apparatus is employed.

Figure 2:
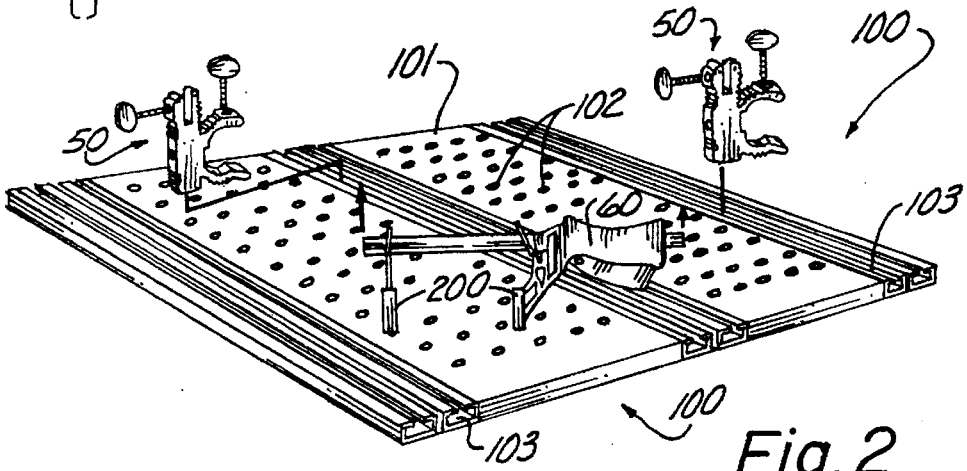
FIG. 2 is an exploded perspective view of a pair of saddle clamps, a bar clamp member, and a work piece disposed in its intended environment.

As shown in FIG. 2, the apparatus 10 is designed and intended for use in conjunction with a generally planar support surface 100 comprising a rigid support surface 101 provided with a plurality of apertures 102 and spaced rows and further provided with a plurality of channel track members 103.

As can also be seen by reference to FIG. 2, the work piece clamping apparatus 10 comprises in general a pair of saddle clamps 50 employed in conjunction with a bar clamp 60 to suspend the bar clamp member above the generally planar work surface 100 to immobilize a work piece 200 at a desired location with respect thereto.

The saddle clamp 50 comprises in general a saddle clamp member 51 having a recessed portion 52 dimensioned to receive one end of the bar clamp 60 and further having an enlarged generally c-shaped recess 53 dimensioned to receive one end of a section of pipe 300, depicted in phantom.

Still referring to FIG. 1, it can be seen that the saddle clamp member 51 is provided with a plurality of threaded apertures 54 dimensioned to receive securing members 55 and threaded mounting members 56 and 57 which will be described presently. Securing mounting members 56 and 57 comprise elongated threaded elements, wherein mounting member 56 is threaded along its entire length and mounting member 57 is threaded on only one end. In addition, mounting member 56 is further designed to cooperate with a female threaded member 58, as will be explained presently in conjunction with FIG. 3.

Still referring to FIG. 1, it can be seen that mounting member 56 is dimensioned to be received in a threaded aperture in the bottom of the saddle clamp member 51 as shown in FIG. 1 and also dimensioned to be received in the threaded aperture 54 in the side of saddle clamp member 51. In addition, the threaded end of mounting member 57 is dimensioned to be received in either the bottom threaded aperture 54 or the side aperture 54. The reason for that is that the saddle clamp member 51 may be secured in a variety of orientations with respect to diverse components.

Figure 3:
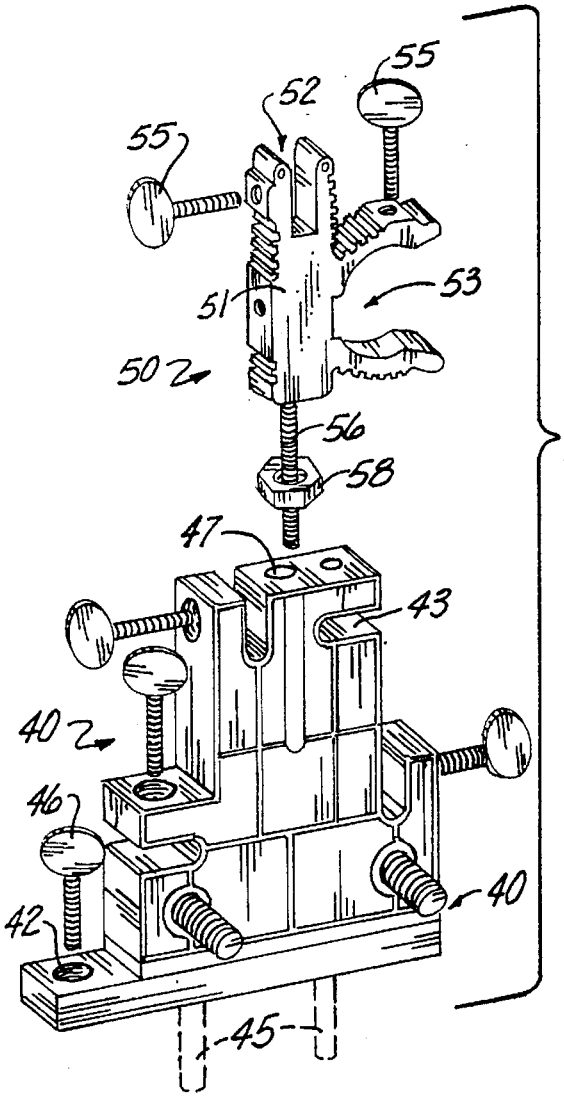
FIG. 3 is an exploded perspective view of a saddle clamp member employed with a gridlock member and one embodiment of the invention.

As shown in FIG. 3, the saddle clamp element is designed to be operably attached to a grid block member 40 by use of the threaded mounting member 56 and cooperating female threaded element 58, wherein the lower portion of the mounting member 56 is dimensioned to be received in an enlarged aperture 57 in the top portion of the grid block member 40. In this particular arrangement, the female threaded element 58 can be rotated relative to the mounting member 56 to vary the height of the saddle clamp element above the top of the grid block member 40, wherein the grid block member 40 may be optionally received either in the channel tracks 103 of the planar support surface 100 or, by using the mounting post 45, may be received in the apertures 102 of the planar support surface 100, in a well recognized manner.

Figure 4:
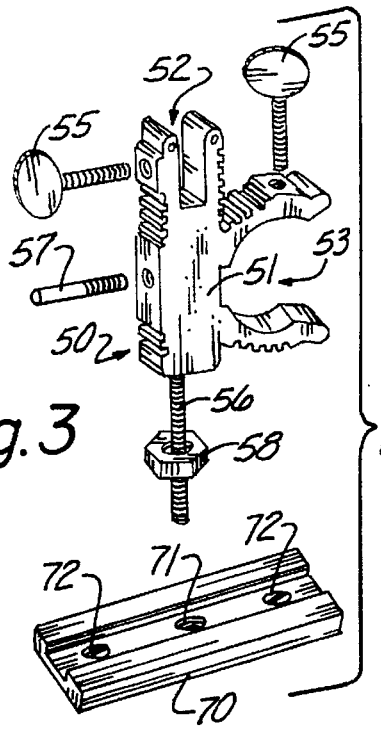
FIG. 4 is an exploded perspective view of the saddle clamp member in conjunction with a lock member 70 employed in conjunction with the work piece clamping apparatus of this invention.

Turning now to the embodiment illustrated in FIG. 4, the saddle clamp member 50 may be secured to a locking member 70 provided with a suitable threaded aperture 71 to receive the threaded mounting member 56; wherein the locking member 70 is dimensioned to be received in the track channels 70 of the generally planar support member and fixedly secured at a desired location therein by a fastening means 72.

At this juncture, it should be apparent that the respective pairs of saddle clamp elements 50 may be disposed in either a horizontal or vertical orientation relative to the generally planar support member 100 as well as being disposed in a rotary disposition with respect thereto for securing a section of pipe 300 or the opposite ends of a bar clamp 60 which would be used to fixedly position a work piece 200 relative to the rigid support surface.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A workpiece clamping apparatus for securing pipes and bars to a planar support surface provided with a plurality of spaced apertures and a plurality of channels wherein the workpiece clamping apparatus comprises a pair of saddle clamp members wherein each saddle clamp member is provided with an enlarged generally C-shaped recess dimensioned to receive a section of pipe and a recessed portion dimensioned to receive a portion of a bar; and each saddle clamp member is further provided with a plurality of threaded apertures securing means operatively associated with said enlarged C-shaped recess and said recessed portion for captively engaging said section of pipe and said portion of a bar mounting means associated with each saddle clamp member for operatively securing each saddle damp member selectively in the apertures and channels in the planar support surface such that the saddle clamp member may be selectively disposed in a horizontal or vertical orientation; and adjustment means associated with the mounting means for varying the height of the saddle clamp member relative to said planar support surface.

2. The workpiece clamping apparatus as in claim 1; wherein, said mounting means comprises:

a threaded member having a first end dimensioned to be received in said plurality of spaced apertures and a second end dimensioned to be received in said plurality of threaded apertures in each saddle clamp member.

3. The workpiece clamping apparatus as in claim 2; wherein, said mounting means further comprises:

a mounting member dimensioned to be slidably received in the plurality of channels in the planar support surface and provided with an aperture dimensioned to receive the first end of said threaded member.

4. The workpiece clamping apparatus as in claim 3; wherein, the first end of the threaded member has a threaded exterior surface.

5. The workpiece clamping apparatus as in claim 2; wherein, the first end of the threaded member has a smooth continuous exterior surface.

6. The workpiece clamping apparatus as in claim 2; wherein, said adjustment means is threadedly engaged with the second end of said threaded member.

* * * * *